US009546506B1

(12) United States Patent
Kangatharalingam

(10) Patent No.: US 9,546,506 B1
(45) Date of Patent: Jan. 17, 2017

(54) SECURITY DEVICE FOR SWINGING AND SLIDING DOORS

(71) Applicant: Nirmalakanthi Kangatharalingam, Stillwater, OK (US)

(72) Inventor: Nirmalakanthi Kangatharalingam, Stillwater, OK (US)

( * ) Notice: Subject to any disclaimer, the term of this patent is extended or adjusted under 35 U.S.C. 154(b) by 124 days.

(21) Appl. No.: 14/506,641

(22) Filed: Oct. 4, 2014

(51) Int. Cl.
*E05C 19/18* (2006.01)
*E05C 19/10* (2006.01)

(52) U.S. Cl.
CPC ..... *E05C 19/18* (2013.01); *E05C 19/10* (2013.01)

(58) Field of Classification Search
CPC ..... Y10T 292/283; Y10T 24/3902; Y10T 292/28; Y10T 292/087; Y10T 70/5164; Y10T 24/2125; Y10T 24/312; Y10T 24/45969; Y10T 292/0911; E05C 17/365; E05C 17/36; E05C 19/10; E05B 67/383; E05B 73/00
USPC ..... 292/145, 262–278, 288
See application file for complete search history.

(56) References Cited

U.S. PATENT DOCUMENTS

| | | | | |
|---|---|---|---|---|
| 1,920,669 | A * | 8/1933 | Riccelli | E05F 11/00 292/150 |
| 3,762,752 | A | 10/1973 | Saunders | |
| 3,816,967 | A | 6/1974 | Littrell | |
| 4,082,334 | A | 4/1978 | Volta | |
| 4,262,503 | A | 4/1981 | Kuebler | |
| 4,295,676 | A | 10/1981 | Smith | |
| 5,269,100 | A | 12/1993 | Fontenot | |
| 6,058,563 | A | 5/2000 | Bucknell | |
| 2009/0013739 | A1 | 1/2009 | Vyskocil | |
| 2012/0235427 | A1 | 9/2012 | Miskel | |

* cited by examiner

*Primary Examiner* — Mark Williams

(57) ABSTRACT

One embodiment of a simple door security device comprising a generally U-shaped member, and staple assemblies is structured with heavy-duty material and construction. The generally U-shaped member of the embodiment functions to secure doors when installed on the staple assemblies mounted appropriately on doors, or the combination of doors and door-frames. The generally U-shaped member also secures doors when installed on a staple assembly and a door handle, or two door handles. Each staple assembly is secured to doors or door-frames using six fastener means. The installed, generally U-shaped member is secured by a safety hook member, coupled to an attached flexible means on the generally U-shaped member.

1 Claim, 2 Drawing Sheets

SECURITY DEVICE FOR SWINGING AND SLIDING DOORS

BACKGROUND

Prior Art

The following is a list of prior art that appears relevant:

| Pat. No. | Kind code | U.S. patents issue date | Patentee(s) |
|---|---|---|---|
| 20120235427 | A1 | 2012 Sep. 20 | Miskel, Hagler, Murphy |
| 20090013739 | A1 | 2009 Jan. 15 | Vyskocil |
| 6,058,563 | A | 2000 May 9 | Bucknell |
| 5,269,100 | A | 1993 Dec. 14 | Fontenot |
| 4,295,676 | A | 1981 Oct. 20 | Smith |
| 4,262,503 | A | 1981 Apr. 21 | Kuebler |
| 4,082,334 | A | 1978 Apr. 4 | Volta, Martin |
| 3,816,967 | A | 1974 Jun. 18 | Littrell |
| 3,762,752 | A | 1973 Oct. 2 | Saunders |

Securing doors from unauthorized entries and intrusions is an important part of human safety and security. There are various kinds of doors in homes and other buildings. Entry doors, patio doors and side doors are vulnerable to unauthorized entry and intrusion. Various kinds of prior art security devices have been designed for doors. Most of the mechanical security devices for doors have been designed for specific kinds of doors or specific category of doors such as swinging doors or sliding doors.

Saunders invented a door security device that is described as an improvement over chain guards for swinging doors only. Littrell, and Smith invented security bars for sliding doors such as patio doors where one panel slides and the other remains fixed. Further limiting the security bars of Littrell, and Smith is their inapplicability to swinging doors. The interior security device for double doors invented by Volta and Martin engages two door knobs to secure the two doors. This device is specific for double doors, thus limiting its application.

The door security device invented by Kuebler is useful only in swinging doors even though the device is portable for use in hotel or motel rooms. Fontenot invented a swinging door security device that braces the door and the doorjamb to deter "kick-in" and "pry-in" type intrusions. The security device designed by Bucknell is exclusively for swinging doors, and the device uses a prop mechanism between the door and the adjacent floor surface. The entry door security device invented by Vyskocil prevents the deadbolt knob element from rotating when engaged with a key from outside, and is not useful for sliding doors or swinging doors without deadbolts. The invention by Miskel, Hagler and Murphy is a security device specifically for double doors that engages two door knobs or door handles securely, thereby preventing the doors from opening. It is apparent from the foregoing that most mechanical door security devices of prior art are designed exclusively for specific types of doors.

Simple, affordable, easy to install and effective security devices for doors are preferred over complex and more expensive devices. There are various electronic door security devices that can be applied to different kinds of doors.

However these devices are complex and expensive. Door security devices designed to cover a wide range of door types while being simple, affordable, and effective would have definitive advantages and merits.

SUMMARY

The present invention comprises a security device for multiple door types. The primary objective of the present invention is to provide a simple, easy to use, affordable but effective security device that covers a range of door types. According to one embodiment, my door security device comprises a heavy-duty rigid cable loop. At the middle of the cable loop is an attached strong, flexible means with a terminal hook that prevents unexpected and unauthorized removal of the cable loop.

In accordance with another embodiment of the security device, heavy-duty staple assembly devices provide the means for engagement of the said cable loop. The cable loop can also engage a staple and a door handle, or two door handles. The staple assemblies are fastened to doors or door-frame structures with multiple means. Another objective is to provide a door security device that is economical and easy to manufacture. The present invention provides security for a variety of swinging and sliding type doors.

Advantages

In accordance with the embodiments, several advantages of one or more aspects are: a multiple application door security device that covers swinging and sliding doors is designed. The structure and construction of the device is strong, durable and heavy-duty for the purpose it serves. The present invention is easy to install, easy to use, reliable and affordable. Further features and advantages of one or more aspects will be apparent from the accompanying drawings and ensuing description.

DRAWINGS

Figures

In the accompanying drawings, closely related figures have the same number but different suffixes. Like elements are assigned like reference characters. The drawings are not necessarily to scale, and are only for the purpose of illustrating one or more embodiments of the invention including their principles and are in no way limiting the invention. A brief description of the drawings is as follows.

DRAWINGS

Reference Characters

Figure 1:
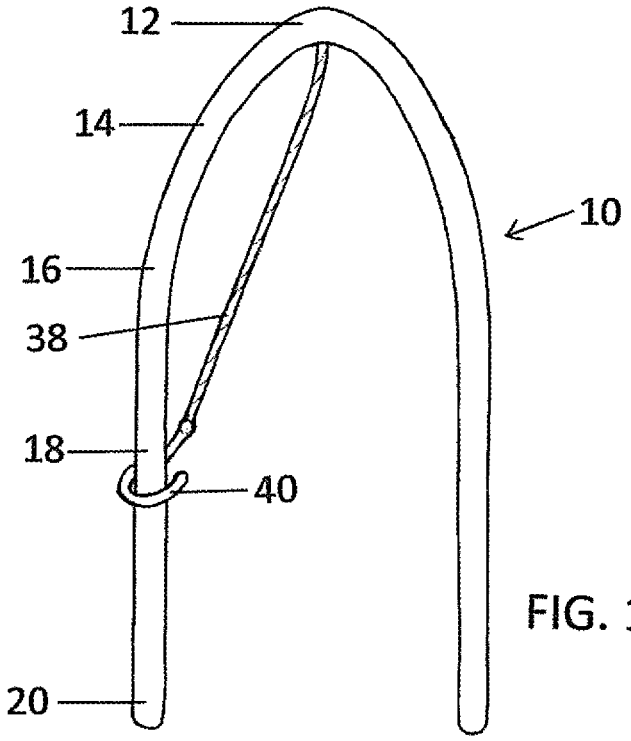
FIG. 1 shows the full view of the cable loop with the attached flexible member and the terminal hook.

10 cable loop
12 top end of cable loop
14 tapering part of cable loop
16 upper end of cable loop straight arm
18 straight arm of cable loop
20 terminal part of cable loop
22A boundary line between the door-frame and a sliding door panel with a handle

22B boundary line between a swinging door and the door-frame
24 sliding door panel handle
26 staple assembly
28 staple assembly base plate
30 staple loop
32 base plate staple loop pivot point
34 base plate screw holes
36 staple assembly screws
38 flexible member attached to cable loop
40 safety hook that prevents unexpected removal of cable loop

DETAILED DESCRIPTION OF EMBODIMENTS OF THE INVENTION

Figure 2A:
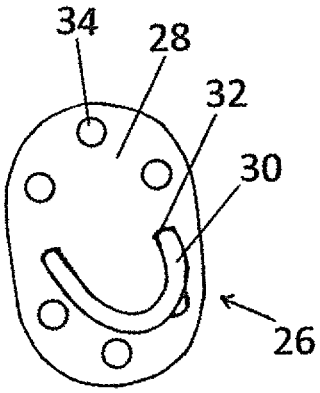
FIGS. 2A to 2B show two views of the staple assembly.
Figure 2B:
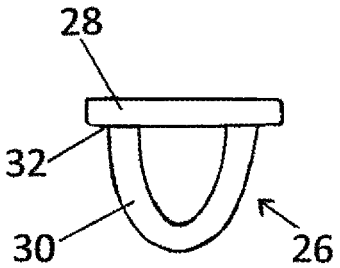
Figure 3:
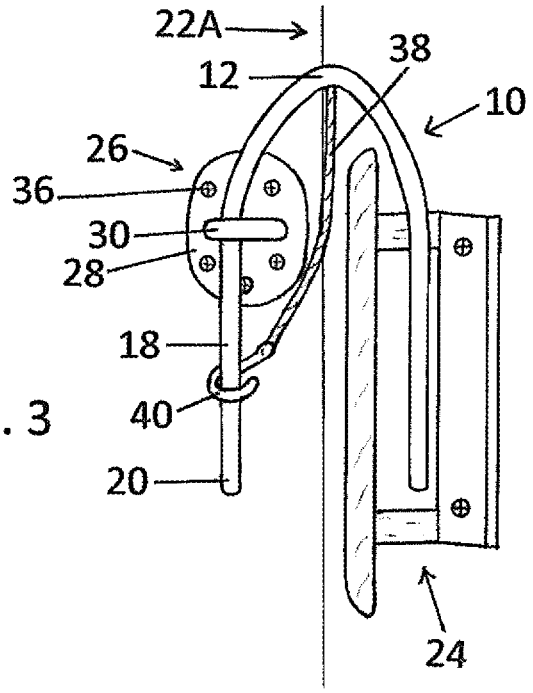
FIG. 3 shows one view of the security device engaged between the handle of a sliding door panel and the staple assembly installed on the door-frame.
Figure 4:
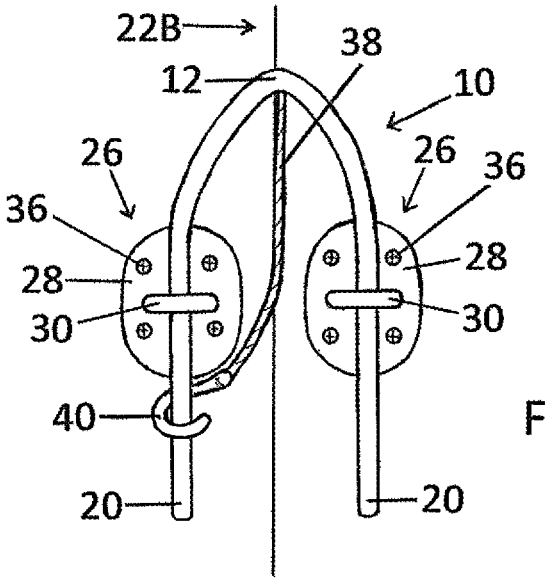
FIG. 4 depicts one view of the security device installed between a swinging door and the door-frame via two mounted staple assemblies.

The preferred embodiments of the invention are illustrated in FIGS. 1, 2A-B. The preferred embodiments comprise the cable loop 10 with the flexible member 38, the attached terminal hook 40 and the staple assembly 26 together with the screws. The cable loop 10 is preferably structured using a rigid, solid, heavy-duty metal with high tensile strength. The solid, generally cylindrical metallic cable loop 10 is structured to appear somewhat like a "U" with tapering parts 14, and straight arms 18 as illustrated in FIG. 1. At the top end 12 of the cable loop 10 is a strong flexible member 38 having a terminal hook 40. The flexible member 38 and the hook 40 are structured using high tensile strength, heavy-duty metal. The preferred embodiment of the staple assembly 26 as illustrated in FIGS. 2A-B comprises a base plate 28 on which are six screw holes 34, and the staple loop 30 is firmly mounted to the base plate 28 at the pivot point 32. The staple loop 30, as shown in FIG. 2B, has two tapering sides to provide a wider base. The staple base plate 28 and the staple loop 30 are structured using high tensile strength, heavy-duty metal. The screws used to install the staple assemblies 26 to the door and door-frames are standard Philips type screws 36 of high tensile strength as shown in FIGS. 3, 4. Six screws 36 are used per staple assembly 26 to provide the required firmness.

In the configuration depicted in FIG. 3, the present door security device is installed on a sliding patio door, where one panel slides and locks to the side frame, demarcated in FIG. 3 by the boundary line 22A between the two. The staple assembly 26 of the device is installed on the patio door side frame using six screws 36. The cable loop 10 of the device is installed engaging the loop 30 of the staple assembly 26 mounted on the door-frame and the sliding panel handle 24 of the patio door as shown in FIG. 3. The cable loop 10 is adapted or configured to install by simultaneously inserting the terminal parts 20, one through the staple loop 30 and the other over the door handle 24 to engage the handle 24 as illustrated in FIG. 3. The cable loop 10 is then pushed down so that the upper end 16 of its straight arm 18 reaches the staple loop 30. After installing the cable loop 10 as described, the safety hook 40 that is attached to the disengaged flexible member 38, is now engaged on the straight arm 18 of the cable loop 10 below the staple loop 30. Once installed as shown in FIG. 3, the safety hook 40 secures the cable loop 10 in position and prevents it from any unexpected removal.

The illustration in FIG. 4 shows how the door security device is installed on a swinging door with a frame. The staple assemblies 26 are installed one on the door frame and another on the door panel demarcated in FIG. 4 by the boundary line 22B. Each staple assembly 26 is secured using six screws 36. The cable loop 10 is installed by simultaneously inserting the terminal parts 20 through each of the two staple loops 30 (see FIG. 4). The cable loop 10 is then pushed down so that the upper end 16 of its straight arm 18 reaches the staple loop 30. After installing the cable loop 10 as described, the disengaged safety hook 40 that is attached to the flexible member 38 is engaged on the straight arm 18 of the cable loop 10 below the staple loop 30. Once installed as shown in FIG. 4, the safety hook 40 secures the cable loop 10 in position and prevents it from any unexpected removal. The installation and configuration illustrated in FIG. 4 can also be applied to swinging double doors. In double doors, the staple assemblies 26 are installed on each of the two door panels, or the cable loop 10 can simply be installed connecting handles of the two door panels. The present security device can also be used on gates.

The preferred embodiments of the present invention are preferably made of non-corrosive metal of sufficient strength and temper to withstand the possible stresses and strains in the purposes served. The embodiments of the cable loop 10 and staple loop 30 are preferably structured to be generally cylindrical with a diameter of 3-7 mm, and the staple base plate with 1.5-3 mm thickness.

FURTHER ADVANTAGES

From the illustrations, descriptions and operational details provided herein, a number of advantages of some embodiments of my present invention become evident:

a) The broad application of the security device to various types of swinging and sliding doors is an important advantage.
b) The staple assembly that is an important part of the security device can be installed on wooden and metallic doors and door-frames.
c) The cable loop that is an essential part of the security device can be installed on two staple assemblies, two handles, or one staple assembly and one handle thereby allowing wide use of my security device, a clear advantage.
d) The safety hook that is attached to the flexible member mounted to the top end of the cable loop secures the cable loop after installation to prevent any unwanted removal of the cable loop, including any unauthorized attempts.
e) The use of six strong screws to install each of the staple assemblies provides significant strength and firmness to the staple assembly.
f) The preferred material used in the present invention is selected for corrosion resistance, rigidity and strength to withstand possible stress and strain in its utility. These features and its heavy-duty construction make the present invention reliable, durable, valuable and preferable as a door security device.
g) My present invention can also be used as security device on gates such as backyard gates with wooden or metal frames.
h) Being simple in its structure and design makes manufacturing of the present device economical and affordable.
i) The present invention is simple, easy to install and easy to use while being reliable and effective.

SCOPE

Even though several embodiments of the present invention have been illustrated and described, it is recognized that other variations are possible in regards to features, components, material and configurations. Those skilled in the art will recognize that modifications, alterations, additions, and/or deletions may be made to the currently preferred embodiments without departing from the spirit and scope of the invention.

Accordingly, the scope of the embodiments should be determined by the appended claims and their legal equivalents, rather than by the illustrations, descriptions and examples provided herein.

I claim:

1. A mechanical door security device, comprising in combination:

a solid, generally cylindrical, generally uniform diameter, substantially U-shaped member, two staple assemblies, said staple assembly having a staple loop coupled to a base plate, said base plate having six fastener holes, said U-shaped member comprising, a top end, two terminal parts, an elongated flexible means having a proximal end and a terminal end, said proximal end of said flexible means is firmly affixed to the top end of said U-shaped member, said terminal end of said flexible means is coupled to a terminal safety hook, said U-shaped member further comprising, two generally straight arms ending in said two terminal parts, said door security device is structured using rigid, heavy duty material resistant to corrosion;

said door security device provides for use on sliding and swinging doors in fully closed position thereof, to preclude opening said doors when said device is installed on the interior side of said doors, said staple assembly is fastened onto a door frame or door panel, each of said two generally straight arms of said U-shaped member engages said staple loop of one of two fastened staple assemblies, or one of two said straight arms engages the staple loop of a fastened staple assembly and the other being adapted to engage a door handle respectively, said terminal safety hook engages onto one of two said straight arms to secure the U-shaped member installed on the door;

said two generally straight arms, one engages a staple loop and the other adapted to engage a door handle respectively of a closed sliding door thereby preventing the door from sliding, wherein said staple assembly is fastened onto the sliding door frame adjacent to said door handle; in use on a closed single swinging door, said two generally straight arms of said U-shaped member, each engages one of two staple loops of fastened staple assemblies, one staple assembly is fastened on the swinging door frame and the other near the edge of the single swinging door panel adjacent to said door frame, whereby the installed said U-shaped member prevents the swinging door from swinging;

the six base plate fastener holes receive six fasteners when said staple assembly is fastened, the terminal part of said U-shaped member slides through said staple loop allowing engagement of a straight arm, wherein the two straight arms of said U-shaped member simultaneously engage two fastened staple assemblies, or adapted to simultaneously engage a staple assembly and a door handle, whereby said door security device when installed, provides substantial security beyond locks, precluding opening doors from outside.

* * * * *